US005347785A

United States Patent [19]

Terrenzio et al.

[11] Patent Number: 5,347,785

[45] Date of Patent: * Sep. 20, 1994

[54] TWO ELEMENT SHINGLE

[75] Inventors: Louis A. Terrenzio, Huntingdon Vally; Michael J. Noone, Wayne, both of Pa.

[73] Assignee: CertainTeed Corporation, Valley Forge, Pa.

[ * ] Notice: The portion of the term of this patent subsequent to Jul. 20, 2010 has been disclaimed.

[21] Appl. No.: 898,793

[22] Filed: Jun. 15, 1992

[51] Int. Cl.[5] ..... E04D 1/28

[52] U.S. Cl. ..... 52/555; 52/523; 428/489

[58] Field of Search ..... 52/518, 523, 554, 555; 428/489

[56] References Cited

U.S. PATENT DOCUMENTS

| | | | |
|---|---|---|---|
| 2,253,652 | 8/1941 | Ritter | 52/518 |
| 3,624,975 | 12/1971 | Morgan et al. | 52/555 |
| 4,634,622 | 1/1987 | Jenkins et al. | 427/186 |
| 4,636,414 | 1/1987 | Tajima et al. | 428/489 |
| 4,717,614 | 1/1988 | Bondoc et al. | 52/555 |
| 4,738,884 | 4/1988 | Algrim et al. | 428/489 |

*Primary Examiner*—Carl D. Friedman
*Assistant Examiner*—Christopher T. Kent
*Attorney, Agent, or Firm*—Paul & Paul

[57] ABSTRACT

A decorative shingle has a first element including a reinforcing web, a first asphaltic binder, and a first adherent surfacing material. A second element including discontinuous sections is overlaid on the first element. The second element includes a layer of a second asphaltic binder and a second adherent surfacing material to provide a decorative effect. The second asphaltic binder has greater elongation at low temperature than the first asphaltic binder, providing greater resistance to environmental stresses.

22 Claims, 8 Drawing Sheets

TWO ELEMENT SHINGLE

BACKGROUND OF THE INVENTION

1. Field of the Invention

The present invention relates to weather-resistant exterior construction materials, and more particularly to roofing and shingle products.

2. Brief Description of the Prior Art

Roofing products formed from laminated multiple layers of shingle material are well known. For example, roofing shingles in which a base shingle is overlaid with one or more sections of shingle material to provide a decorative three-dimensional effect are known. In these shingles, both the base and the overlaid section include a reinforcing web formed, for example, from glass fiber, and the base and overlaid sections are laminated together. A well-defined three-dimensional appearance can be provided through selection of the geometry of the over laid sections, the placement of the overlaid sections on the base shingle, and the scheme by which the roof is to be covered with the shingles. However, an important aspect contributing to the ultimate three-dimensional appearance of the roof covering is a sharp discontinuity at the edges of the overlaid sections. This type of shingle can be easily made: The sections can be simply cut from the same material as the base shingles, and the cut sections can be subsequently laminated on the base shingle. On the other hand, the double layering of reinforcing web which results from this assembly contributes to the weight and decreases the flexibility of the shingles. An alternative is to simply overlay one or more sections of asphaltic coating material on top of a base shingle made up of an asphalt-coated reinforcing web in which mineral surfacing material has already been embedded, with additional mineral surfacing material being subsequently embedded in the overlay. While an attractive three-dimensional appearance can be achieved with this alternative, the shingle produced may be substantially thicker through the overlaid sections than through the base shingle, which may decrease the flexibility of the product in comparison with the base shingle. The decreased flexibility may make the overlaid shingle more difficult to install on roof hips and roof ridges, where the shingle must be bent substantially to conform to the roof surface.

SUMMARY OF THE INVENTION

The present invention provides an improved shingle having overlaid sections and having improved durability and granule adhesion, and enhanced flexibility providing for easier installation on roof hips and ridges, while at the same time providing an enhanced three-dimensional appearance. The improved shingle also has greater resistance to damage from roof deck movement, temperature cycling, and other mechanical stresses and retains that resistance as a function of age to a much greater degree than conventional shingles. The improved shingle comprises a first element, or base shingle, which includes a reinforcing web, preferably, but not restricted to, glass fibers, a primary layer of mineral-stabilized asphalt coating, and a first adherent surfacing material, preferably of mineral granules which are embedded in the first asphaltic coating material. The improved shingle also includes a compliant second element overlaid on the first element. This second element can include several discontinuous sections, and comprises a layer of a second asphaltic binder or coating and a second adherent surfacing material, preferably of mineral granules embedded in the second asphaltic coating. Different grades and/or shades of mineral granules can be embedded in the first and second elements, to provide an attractive three-dimensional appearance. Preferably, the edge formed by the second element when the second element is discontinuous is clearly defined appearance, thus contributing to the three-dimensional effect. A wide variety of roofing products, such as slate, wood, tile, and laminated asphalt shingle products can be simulated by the overlay shingles of the present invention.

In the present invention, the second asphaltic binder preferably has greater elongation or extensibility than the first asphaltic binder. The improved elongation is preferably exhibited even at low temperatures, such as, for example, −1° C. The improved elongation can be a result of the presence of additives which also enhance the ductility at low temperatures and contribute greater resistance to changes in properties as a function of time or temperature than the first asphaltic binder exhibits. Preferably, the elongation of the second asphaltic binder is at least two percent, even after extensive exterior exposure, such as that simulated by accelerated carried out by storing shingles made with the second asphaltic binder at 70° C. for at least 10 weeks.

Despite the improved elongation of the second asphaltic binder, it is preferred that the modulus and toughness of the second asphaltic binder be sufficiently great so that "scuffing" of the shingles of the present invention is avoided. Scuffing is mechanical damage to the shingle coating caused by handling during installation, walking on installed shingles, tree branches falling on installed shingles, ice dams, or the like. Thus, while the second asphaltic coating can be somewhat softer (lower modulus) than the first asphaltic coating, it must not be so soft or lack toughness so that it is easily scuffed. It should be noted that a soft, tough coating is permissible and within the scope of the present invention. Preferably, however, the second asphaltic coating is not so soft such that its penetration at 25° C. is greater than about 75 dmm, as measured according to ASTM D-5. Further, it is preferred that the second asphaltic binder be non-adhesive at ambient temperatures, reducing the likelihood that the improved shingles will become stuck together during shipment and prior to installation, or that the second surfacing material will become dislodged by handling during installation or subsequently.

It is preferred that the enhanced low temperature elongation be achieved by including in the second asphaltic binder a composition comprising one or more additives selected from elastomers, plasticizers, and resins, and blends thereof. Preferably, the elastomer is selected from natural rubber and thermoplastic elastomers, including styrene-isoprene-styrene block copolymer, styrene-butadiene-styrene block copolymer, and styrene-ethylene-butadiene-styrene block copolymer. The formulation can also include one or more antioxidants, and additional components such as oils.

DETAILED DESCRIPTION OF THE PREFERRED EMBODIMENTS

Figure 1:
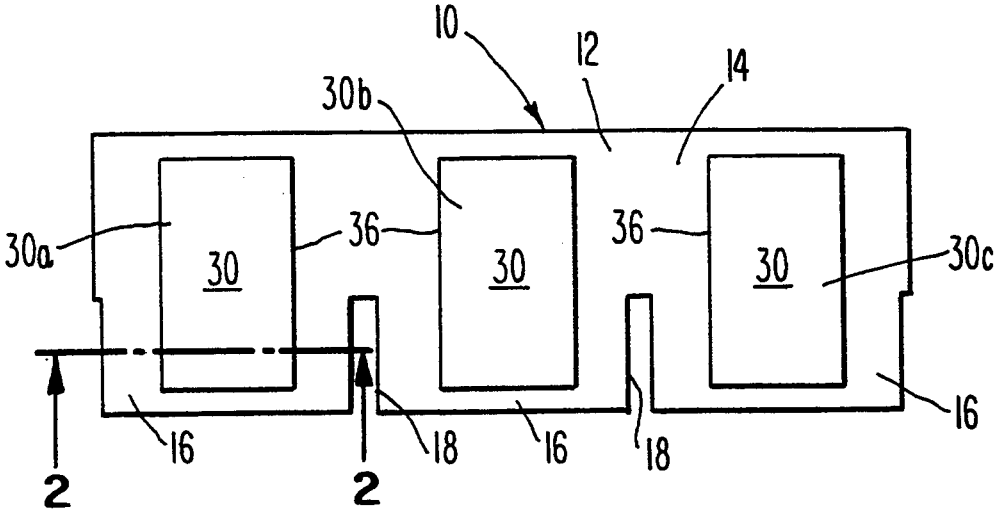
FIG. 1 is a plan view of a first embodiment of a shingle of the the present invention.

Referring now to the drawings in detail, wherein like reference numerals indicate like elements in each of the several views, reference is first made to FIG. 1 wherein an improved shingle 10 according to the present invention is in plan view. The improved shingle 10 includes a first element or base shingle 12 having a butt section 14 and three tabs 16 separated by cut-outs or slots 18. In addition, the improved shingle 10 includes a second element 30 formed by three discontinuous sections 30*a*, 30*b*, 30*c* overlaid on the first element and centered on each of the tabs 16, and extending over portions of the tabs 16 and butt 14 of the shingle 10.

Figure 2:
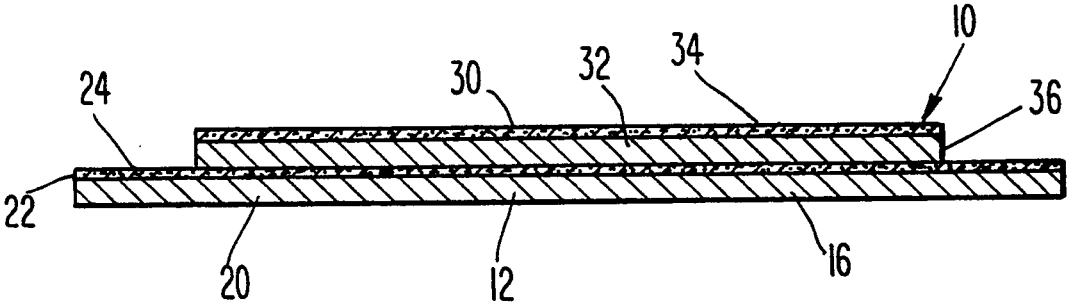
FIG. 2 is a sectional elevational view of the shingle of FIG. 1 taken along the line 2—2.

As shown in FIG. 2, a sectional elevational view taken along the line 2—2 through the shingle 10 of FIG. 1, the first element 12 includes a glass fiber reinforcing web impregnated and coated with a bituminous material 20 covered on top by a layer 22 of a first asphaltic binder or coating in which a first adherent surfacing material 24 comprising mineral granules of a first shade is embedded. The first element 12 can be produced by conventional means, such as by conventional sheet roofing forming and shingle-cutting apparatus. On top of the first element 12 of the shingle 10 the second element 30 is overlaid by printing, stenciling, or other conventional means, and bounded by an edge 36. The second element 30 includes a layer 32 of a second asphaltic binder or coating in which a second adherent surfacing material 34 comprising mineral granules of a second shade. The second asphaltic binder has greater elongation at ambient temperatures than the first asphaltic binder, and the second asphaltic binder is softer than the first asphaltic binder at ambient temperatures. However, the second asphaltic binder is not tacky or adhesive at ambient temperatures, such that stacked shingles do not have a tendency to become stuck together by the second asphaltic binder during shipment and storage. Further, the second asphaltic binder is not so soft, and is sufficiently tough, such that it is easily scuffed by handling during installation, being walked upon after installation of the shingle on a roof, or the like. The greater elongation, the reduced modulus or greater softness, and the toughness of the second asphaltic coating can be measured by conventional means. The edge 36 of the second element 30 is sharply defined (not shown). The second element 30 is clearly apparent when the shingle 10 is installed on a roof and the mineral granules of the first element and the second element are of contrasting colors. The use of both the first element 12 and the second element 30 permits sharper contrast between colors when two or more shades of mineral granules are employed in making the shingle in comparision with conventional methods for making shingles having only a single element. In the latter case, granules of different shades are applied as "blend drops" in which the border between areas of different shades of mineral granules tends to be poorly defined as the granules tend to be intermixed at the edges of these areas.

Figure 3:
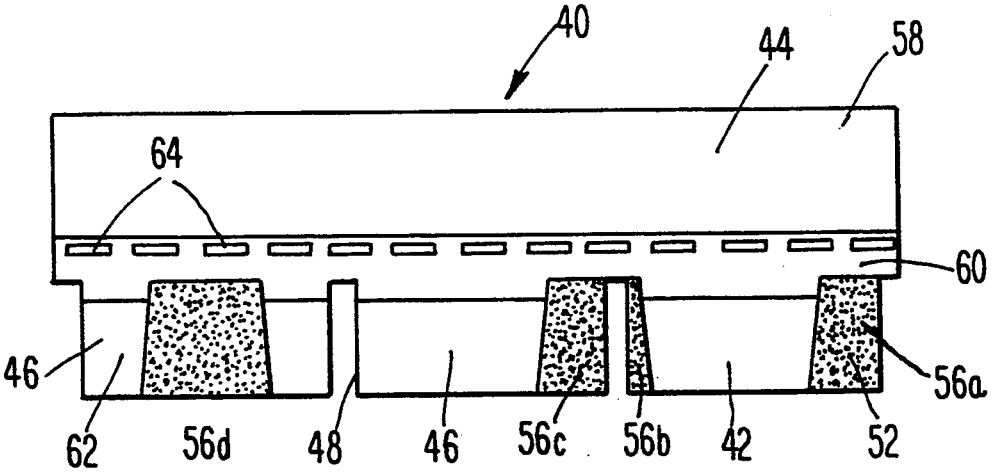
FIG. 3 is a plan view of a second embodiment of a shingle of the present invention.

An improved shingle 40 of a second embodiment of the present invention is shown in FIG. 3 in plan view. This shingle 40 employs a variety of means to achieve a decorative three-dimensional effect when installed on a roof. The improved shingle 40 includes a first element or base shingle 42 having a butt section 44 and three tabs 46 separated by cut-outs 48. The improved shingle 40 also includes a second element 56 formed by a plurality of sections 56*a*, 56*b*, 56*c*, 56*d* overlaid on the first element 42 extending over portions of the tabs 46. The second element 42 includes a layer 52 of a second asphaltic binder or coating.

The base shingle 40 has three different areas or zones 58, 60, and 62 in which different varieties of surfacing materials are embedded. The three zones 58, 60, 62 are formed as "blend drops" and consequently do not have sharply defined zone boundaries, but rather show shades varying gradually at the zone boundaries. The first zone 58 extends over the butt section 44 which is not visible except in the cut-out areas 48 when the shingle 40 is installed on a roof, and includes a first embedded surfacing material, preferably a low cost material such as slag or the like, to provide durability and a generally dark appearance in the cut-out areas. The second zone 60 extends over a portion of the butt section 44 and the immediately adjacent portion of the tabs 46, such that the portion of the second zone 60 extending over the tab 46 is visible when the shingle 40 is installed. The second zone 60 preferably includes a second adherent surfacing material or mineral granule, this second surfacing material having a color darker than that used elsewhere on the tabs 46 visible when the shingle 40 is installed, such that the second zone 60 provides a darkened discontinuous line or "shadow line" when the shingle 40 is installed, thus providing a three-dimensional effect. The third zone 62 extends over other portions of the tabs 46 and includes a decorative third adherent surfacing material.

In the sections 56*a*, 56*b*, 56*c*, 56*d* of the second element 42 which extend over the tabs 46 yet another adherent surfacing material comprising mineral granules of another shade or of different shades are embedded. The shape of the second element 56 on the tabs 46 and the respective colors of the different adherent surfacing materials on the tabs 46 provide a decorative effect suggestive of cedar shakes when the shingles 40 are affixed to a roof (not shown).

A plurality of sealant stripes 64 extend over a portion of the butt section 44 proximate the tab section, the sealant stripes 64 being formed from a bituminous material which becomes or remains tacky at temperatures typically encountered on installed roofs. The function of the sealant stripes 64 is to hold down the tabs of overlaid shingles when the shingles are installed on a roof (not shown). A strip of release material is adhered in registration with the sealant stripes 64 on the back of the shingle 40 (not shown) so that adjacent shingles will not stick together when stacked for shipment.

Figure 4:
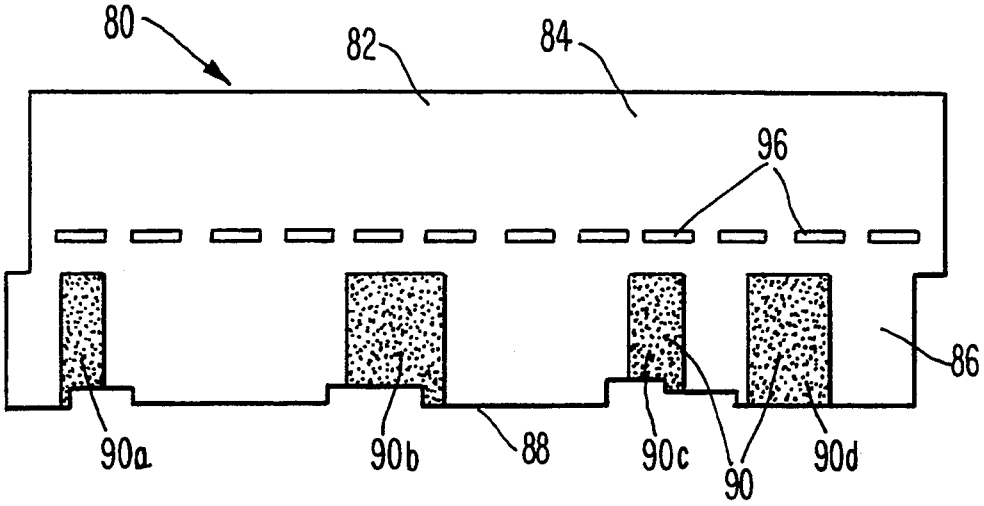
FIG. 4 is a plan view of a third embodiment of a shingle according to the present invention.

An improved shingle 80 of a third embodiment is shown in FIG. 4 in plan view. In this case the shingle 80 comprises a first element 82 formed with a butt section 84 and and a continuous tab section 86 having a staggered lower edge 88 and having a first adherent surfacing material embedded therein. The shingle 80 also has a second element 90 overlaid on the first element 82 in a series of discontinuous sections 90*a*, 90*b*, 90*c*, and 90*d* and having a second adherent surfacing material, of a different shade from the first adherent surfacing material, embedded therein, to provide a decorative effect. The first element 82 may also include a plurality of sealant stripes 96 formed thereon for securing the tabs of overlaying shingles when the shingle 80 is installed on a roof.

Figure 5:
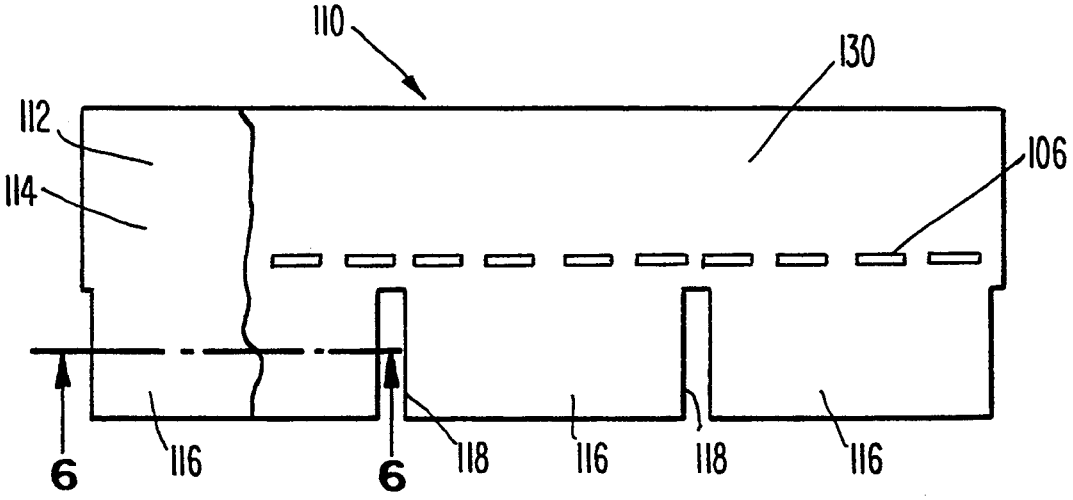
FIG. 5 is a plan view of a fourth embodiment of a shingle according to the present invention.
Figure 6:
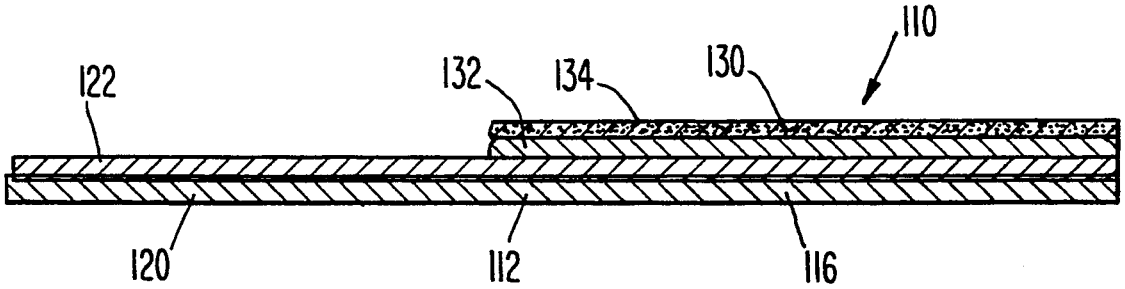
FIG. 6 is a sectional elevational view of the shingle of FIG. 5 taken along the line 5—5.

An improved shingle 110 of a fourth embodiment is shown in FIG. 5 in plan view. In this case the shingle 110 comprises a first element 112 formed with a butt section 114 and three tabs 116 separted by cut-outs 118. The improved shingle 110 also includes a second element 130 laid over the entire upper surface of the first element 112, and a sealant stripe 106 has been overlaid on top of the second element 130. In FIG. 5 a portion of the second element 130 has been cut away to show the underlying first element 112, and a sectional elevational view through a tab 116 of the shingle 110 along the line 5—5 is provided in FIG. 6. The first element 112 includes a glass fiber reinforcing web impregnated and coated with a bituminous material and covered on top with a layer of a first asphaltic binder or coating 122. The second element 130 includes a layer of a second asphaltic coating composition 132 in which an adherent surfacing material 134 has been imbedded. The second asphaltic binder has greater elongation at low temperatures, such as about 0° C., than the first asphaltic binder, and retains an elongation at 0° C. of at least two percent even after years of exterior exposure, such that the shingle 110 shows no cracking.

The first element can include a reinforcing web of a conventional type, such as a woven fabric or a nonwoven web of fibrous materials, for example, a nonwoven web or felt of glass fibers, synthetic organic fibers such as polyester fibers, natural organic fibers such as cellulose fibers, rag fibers, mineral fibers, mixtures of glass and synthetic fibers, or the like. The nonwoven web can optionally include a synthetic resin binder. The web or fabric can be saturated or impregnated and coated with a bituminous material to bind and weatherproof the fiberous material. Examples of bituminous saturants include asphaltic products such as soft native asphalts, soft residual asphalts, soft or slightly blown asphalts, petroleum asphalts, mixtures of one or more of these to obtain a desired consistency, and mixtures of one or more with hardening amounts of harder native asphalts, residual asphalts, or blown petroleum asphalts, and mixtures with softening amounts of mineral oils, modified oils, synthetic resins, and the like. Bituminous saturants for organic roofing webs typically have a low viscosity at the saturating temperature and saturants for webs used in producing shingles typically have softening points between about 100° F. and 160° F. The hardness of these saturant materials as measured by the penetration at 77° F. is typically greater than about 40—they are soft materials. The type and softening point of the bituminous saturant employed depends to some extent on the nature of the web. When the web is glass fiber felt the coating agent and impregnant is generally an asphaltic material with a softening point between about 190° F. and 240° F. to which a filler, typically ground limestone, is added to about 70 percent by weight.

The first element also includes an asphaltic coating or binder on at least one surface, and preferably both the upper and lower surfaces, of the reinforcing web. The asphaltic coating composition can be prepared from the same types materials employed in preparing the saturant; however, the asphaltic coating composition typically has a harder consistency and a higher softening point. Examples of bituminous materials from which the asphaltic coating composition can be formed include native asphalts, residual asphalts, blown petroleum asphalts, gas oils, mixtures thereof, and the like. Blown petroleum asphalts are preferred. The asphaltic coating composition can include a particulate or fiberous material for filling or stabilizing the composition. Examples of particulate and fiberous fillers include fine grades of silica, calcium carbonate, mica, dolomite, trap rock, fly ash, and inorganic fibers such as mineral wool fibers and silica fibers, and the like.

The first element also includes an adherent surfacing material. The adherent surfacing material can be comprised of moderately coarse mineral particles, free from fines, and angular in habit. Examples include opaque but uncolored granules such as coarsely ground slate, gravel, trap rock, nepheline syenite, granite, shale, and the like; naturally colored slates, greenstone, serpentine, darkly colored sands, basalt, greystone, olivine, and the like; crushed vitrified materials formed from bricks, tiles, slag, and the like; glazed mineral particles; silicated mineral particles such as slate or rock particles treated with pigmented silicate solution and insolubilized by heating; mineral granules coated with a hydraulic cement such as a pigmented Portland cement; mineral granules on which inorganic pigments are precipitated; painted mineral granules; chemically treated mineral granules such as slate granules treated with a dichromate solution and subsequently heated; and dyed mineral granules such as clay dyed with an organic dye. The adherent surfacing material is preferably comprised of those moderately coarse mineral particles known in the art as roofing granules. Grade #9 and grade #11 roofing granules are especially preferred. A single type of mineral granule can be used, or one or more types of mineral granules can be employed, the types differing in color and/or particle size to achieve desired decorative effects. If more than a single particle type is used, the arrangement of the different particle types in the asphaltic coating composition can be similarly adjusted to provide desired decorative and aesthetic effects.

The first element can have the shape of an individual shingle or a strip shingle. The manufacture of shingles of a variety of shapes is surveyed in H. Abraham, *Asphalts and Allied Substances, Vol.* 3, *Manufactured Products* (D. Van Nostrand Co. Inc. New York, Sixth Ed. 1960), pp. 271–279. The manufacture of roofing shingles having a multiple ply appearance is disclosed, for example, in U.S. Pat. No. 4,352,837. A variety of decorative effects can be obtained using this method, including but not limited to decorative shingles such as disclosed in U.S. Pat. No. D. 309,027.

The second element also includes an asphaltic binder or coating, and this asphaltic binder or coating can comprise the same type or types of materials as the asphaltic binder or coating of the first element; however, in the present invention, the second asphaltic binder or coating has greater elongation, and may have have a lower modulus, especially at low temperatures, than the first asphaltic binder or coating. That is, the second asphaltic binder or coating is more extensible, as measured for example by the absence of cracking under stress conditions in which the first asphaltic binder or coating cracks. In particular, the second asphaltic binder preferably has an elongation at break at low temperature, such as at −1° C., of at least two percent, even after accelerated ageing simulating years of exterior exposure, such as at least ten weeks of storage at 70° C. The second binder may also be initially softer or have a lower initial modulus than the first asphaltic binder, as measured for example by a higher pentration, particularly at higher temperatures. However, the second asphaltic binder is not so soft as to be tacky or adhesive under ambient conditions, and preferably it is not so soft so as to "scuff" or suffer mechanical damage from handling during installation, being walked upon after installation, or the like. Further, even soft materials are acceptable as second asphaltic binders provided they are sufficiently tough to avoid scuffing and are not tacky or adhesive under ambient conditions.

Under actual exterior exposure or simulated exterior exposure by accelerated ageing it is often found that the modulus of asphaltic binders tends to increase: The material becomes harder. The increase in modulus is often accompanied by a decrease in extensibility or elongation. As "toughness" conventionally refers to the area under a stress-strain curve, a material which requires increasing stress to attain a fixed strain as it ages can be said to be "tougher." In the present invention the second asphaltic binder can become tougher as it ages, provided it retains the extensibility to provide an elongation at break of at least two percent.

Preferably, the enhanced extensibility is obtained by mixing an additive, a preblended admixture, or several additives with the asphaltic coating material used for the first asphaltic coating. For example, the first asphaltic composition can be a standard, coating-grade asphalt (softening point 200° F.–240° F.), and the second asphaltic composition can be prepared by mixing a jelly-like premixed asphalt modifier, such as those blends comprising from about 30 percent to 70 percent by weight of a thermoplastic block copolymer, the remainder comprising plasticizers, oils, antioxidants and the like to promote polymer/asphalt compatibility, low temperature flexibility and ultraviolet light resistance. Examples of such asphalt modifying compositions include but are not limited to those sold by the Chemseco Division of Sika Corporation (Kansas City, Mo.) under the Sikamod ™ trade mark. The modifying compositions are preferably blended with the steep or coating grade asphalt at a temperature between about 300° F. and 400° F., with agitation sufficient to produce a homogeneous mixture.

Examples of polymeric materials which can be used include that which are known to improve the physical, low temperature, and durability performance characteristics of asphalt, such as atactic polypropylene (APP), isotactic polypropylene (IPP), styrene-butadiene rubber (SBS), chloroprene rubber (CR), natural and reclaimed rubbers, butadiene rubber (BR), acrylonitrile-butadiene rubber (NBR), isoprene rubber (IR), styrene-polyisoprene (SI), butyl rubber, ethylene propylene rubber (EPR), ethylene propylene diene monomer rubber (EPDM), polyisobutylene (PIB), chlorinated polyethylene (CPE), styrene ethylene-butylene-styrene (SEBS), and vinylacetate/polyethylene (EVA). Preferably, a thermoplastic elastomer, such as a block copolymer of polystyrene, polybutadiene, and polystyrene blocks is employed.

Plasticizers may be selected from the group consisting of petroleum-derived oils, phthalate esters (or their derivatives) and mellitates. Various petroleum resins, polyolefins, rosin (or its derivatives), tall oil, terpene and cumaroneindene resins can also be employed.

The addition of a mineral stabilizer or filler is typically desirable in order to reduce the scuffing potential of the shingle overlay, lower the cost, and add strength to the shingle composition. Conventional fillers such as calcitic or dolomitic limestone, talc, sand, mica, wollastonite, vermiculite, pearlite, carbon black, stone dust, ground minerals, or others can be incorporated in the asphaltic composition The asphaltic binder or coating can also include a small amount of antioxidant or mixture of antioxidants such as a sterically hindered phenolic compound having a linear, branched, or radial molecular structure.

Preferably, the formulated asphaltic binder has high thermal stability, good compound stability, physical properties, product consistency, and scuff resistance and strong granule adhesion, is durable and weather resistant, has high resistance to staining and sticking, and is especially resistant to damage under applied stresses at low temperatures, and against ageing under either natural conditions or artificial conditions which simulate shingle exposure over expected service life.

In the examples which follow, standard ASTM testing procedures were employed where indicated.

The illustrative examples which follow illustrate the process of manufacturing the shingle of the present invention. These examples will aid those skilled in the art in understanding the present invention; however, the present invention is in no way limited thereby. In the examples which follow, percentage composition is by weight, unless otherwise noted.

EXAMPLE 1

A modified asphalt (Overlay Asphalt A) was prepared by mixing the following components in a high shear mixer at 193° C. for 45 minutes:

| Component | Weight Percent |
|---|---|
| shingle saturant, a slightly oxidized asphalt with a softening point range of 38° C.–59° C. | 25.0 |
| asphalt flux, unoxidized asphalt with a typical softening point range of 21° C.–49° C. (the softening point of the combined shingle saturant and asphalt flux was 42° C.) | 33.0 |
| Shell 1184 SBS triblock radial elastomer having a styrene content 30 percent by weight | 8.7 |
| Microfil ® 8 carbon black (Cabot Corp.) | 4.1 |
| dilauryl thiodipropionate antioxidant | 0.2 |
| calcium carbonate (dolomitic limestone, sized so that 70 ± 5 percent passes through a 200 mesh sieve) | 29.0 |

The physical properties of Overlay Asphalt A were measured and are compared in Table I below with those of Control Asphalt A, an asphaltic composition comprising 45 percent by weight of a coatings grade asphalt (softening point 117° C.) and 55 percent by weight of the same calcium carbonate used in Overlay Asphalt A, and believed representative of a typical unmodified overlay asphalt composition.

TABLE I

| Property | Overlay Asphalt A | Control Asphalt A |
|---|---|---|
| Initial: | | |
| softening point[1] | 124° C. | 131° C. |
| penetration, 0° C.[2] | 25 dmm. | 9 dmm. |
| penetration, 25° C.[2] | 50 dmm. | 12 dmm. |
| viscosity[3] | 4900 cps | 5570 cps |
| Young's modulus[4] −1° C. | 2,580 psi | 26,860 psi |
| ultimate elongation[5] −1° C. | greater than 56% | 7.1% |
| After aging two weeks at 70° C.: | | |
| Young's modulus[4] −1° C. | 3,950 psi | 48,950 psi |
| ultimate elongation[5] −1° C. | greater than 56% | 1.3% |

[1]The softening point of the asphalt composition was measured using ASTM D-36.
[2]Penetration was measured according to ASTM D-5.
[3]Viscosity was measured using a Brookfield RVT viscometer, spindle #27, at 400° F. The shear rate was is 50 min.$^{-1}$. The procedure for determining viscosity is quite similar to ASTM D4402-87.
[4]Young's modulus was measured using ASTM D-2523.
[5]Ultimate elongation (elongation-at-break) was measured using ASTM D-2523.

Overlay Asphalt A and Control Asphalt A were used to manufacture three tab shingles having overlaid sections of the configurations shown in FIGS. 1, 3 and 4 using conventional fabrication equipment and methods. The shingles had a fiberglass web (about two pound per 100 square feet) coated on either side with a conventional filled grade of coating asphalt (softening point 121° C.), #11 roofing granules being imbedded in the upper surface thereof. Overlays were applied using either Overlay Asphalt A or Control Asphalt A to give Example 1 shingles and Comparative Example 1 shingles respectively. The elongation of specimens of the shingles at −1° C. was measured using ASTM D-2523, both about 2–3 weeks after the shingles had been manufactured, as well as after ageing the shingles for two weeks at 70° C. The results of these measurements are reported in Table II, and show the enhanced flexibility of shingles prepared according to the present invention.

TABLE II

| Property | Example 1 | Comparative Example 1 |
|---|---|---|
| Initial: | | |
| ultimate elongation −1° C. | 2.3% | 1.4% |
| After aging two weeks at 70° C.: | | |
| ultimate elongation −1° C. | 2.0% | 1.2% |

EXAMPLE 2

A modified asphalt (Overlay Asphalt B) was prepared by mixing the following components in a high shear mixer at 193° C. for 45 minutes:

| Component | Weight Percent |
|---|---|
| shingle saturant, a slightly oxidized asphalt with a softening point range of 38° C.–59° C. | 74% |
| Himont AFAX 530 atactic polypropylene (viscosity of 20,000 cps at 191° C.) | 22% |
| Himont PROFAX 6801 isotactic polypropylene (fractional .45 melt-flow homopolymer) | 4% |

Overlay Asphalt B and Control Asphalt B, an asphaltic composition comprising 38 percent by weight of a coating grade asphalt (softening point 107° C.) and 62 percent by weight calcium carbonate, were used to manufacture shingles of the type illustrated in FIG. 3 using conventional fabrication equipment and methods. The shingles had a fiberglass web (~2 lbs/100 sq. ft.) coated on either side with Control Asphalt B and #11 roofing granules were imbedded in the upper surface. An overlay was applied using either Overlay Asphalt B or Control Asphalt B to give Example 2 and Comparative Example 2 respectively.

The elongation of the shingles at −1° C. was measured using an Instron Tensile Tester according to ASTM D-2523 just after the shingles were manufactured, as well as after ageing the shingles for two and ten weeks at 70° C. The results of these measurement are reported in Table III, and also show the enhanced flexibility of shingles prepared according to the present invention.

TABLE III

| Property | Example 2 | Comparative Example 2 |
|---|---|---|
| Initial: | | |
| ultimate elongation −1° C. | 3.8 ± 0.3% | 2.6 ± 0.4% |
| After aging two weeks at 70° C.: | | |
| ultimate elongation −1° C. | 3.0 ± 0.4% | 1.6 ± 0.3% |
| After aging ten weeks at 70° C.: | | |
| ultimate elongation −1° C. | 3.0 ± 0.4% | 1.7 ± 0.5% |

Figure 7:
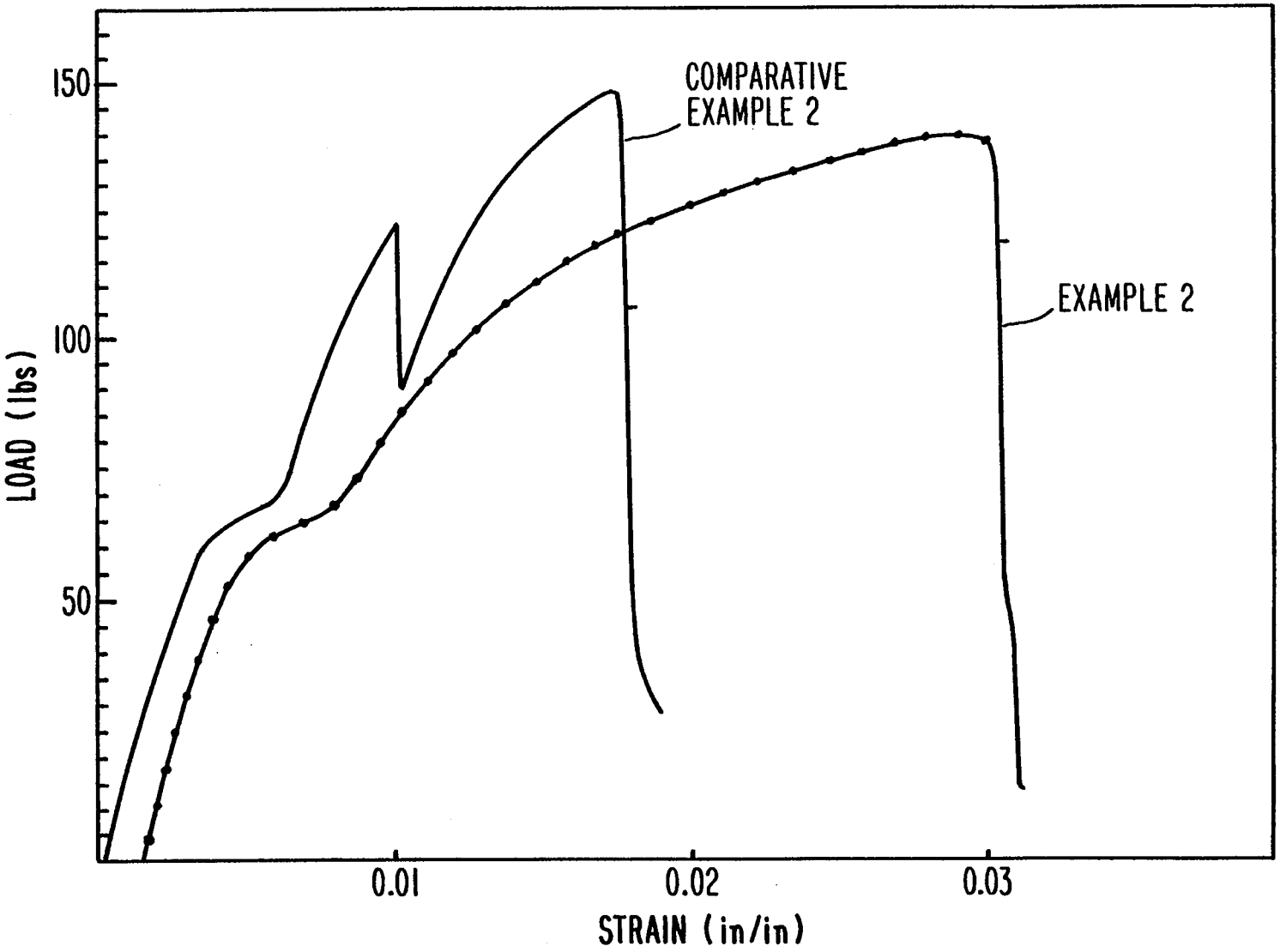
FIG. 7 is a graph of stress versus strain for a shingle of the present invention and a control measured at −1.1° C. after ageing two weeks at 70° C.
Figure 8:
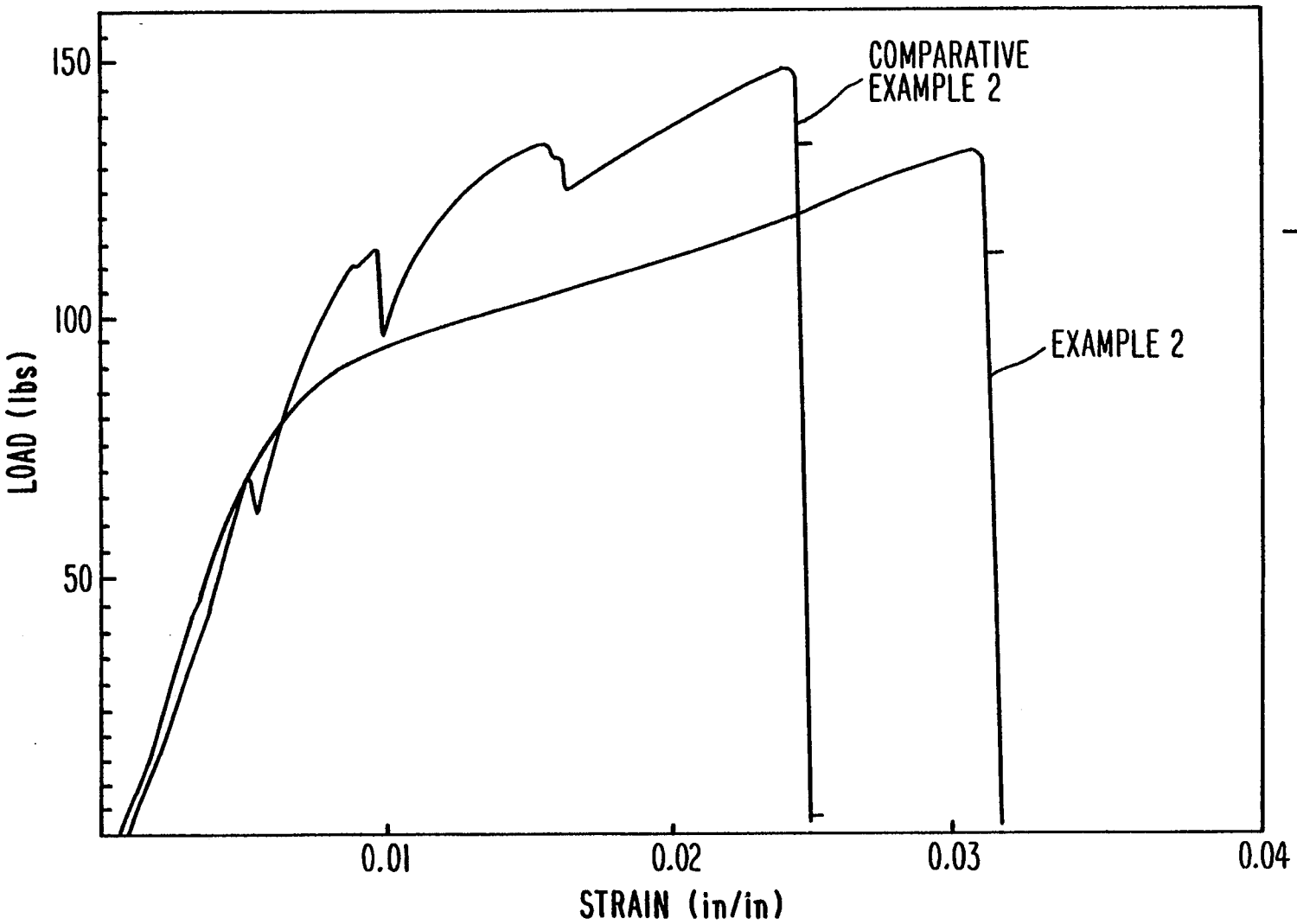
FIG. 8 is a graph of stress versus strain for the shingles of FIG. 7 after ageing ten weeks at 70° C.

FIGS. 7 and 8 are stress-strain curves measured at −1.1° C. for Example 2 and Comparative Example 2 after accelerated ageing periods of 2 and 10 weeks, respectively. Accelerated ageing is achieved by storing the shingle specimens in an oven at 70° C. for a given time period. On each graph, the "blips" recorded on the Comparative Example 2 specimens represent cracking of the shingle overlay. Note that the modified overlay exhibits no signs of cracking, even after ten weeks' ageing. Generally, the first signs of overlay cracking are evident at a level of 1% strain. However, as the ageing period increases, cracks begin to propagate at lower strain levels (0.5%). Also, cracks tend to become more numerous as ageing progresses.

EXAMPLES 3 and 4

A modified asphalt (Overlay Asphalt C) was prepared in a plant-scale trial (batch size approximately 9000 lbs.) by mixing the following components in a low shear mixer at 420° F. for two hours after the final addition of components:

| Component | Weight Percent |
|---|---|
| shingle coating, a highly oxidized asphalt with a softening point of 212° F. | 33.1% |
| dolomitic limestone in which 70% ± 5% of the particles have a particle size less than or equal to 75 microns | 60.9% |

-continued

| Component | Weight Percent |
|---|---|
| monomeric phthalate ester plasticizer having molecular weight of 475; | 1.0% |
| elastomer:mineral oil blend (1:2.5 w/w) blend of styrene-butadiene block copolymer with a styrene content of 45% w/w and a low molecular weight $C_{15}$ aliphatic hydrocarbon | 5.0% |

The physical properties of Overlay Asphalt C were measured and are compared in Table IV below with those of Control Asphalt C, a composition compromising 35.2% by weight of the same shingle coating grade asphalt and 64.8% by weight of the same calcium carbonate extender, and believed to be representatice of a typical unmodified overlay composition.

TABLE IV

| Property | Overlay Asphalt C | Control Asphalt C |
|---|---|---|
| softening point[1] | 240° F. | 247° F. |
| penetration (32° F.)[2] | 19 dmm | 9 dmm |
| viscosity (400° F.)[3] | 2700 cps | 2110 cps |
| Young's modulus (20° F.)[4] | 8930 psi | 34590 psi |
| ultimate elongation (20° F.)[5] | 14.0% | 4.7% |
| glass transition[6] temperature | −52° C. | −32° C. |

[1]The softening point of the asphalt composition was measured using ASTM D36.
[2]Penetration at 32° F. was measured in accordance with ASTM D5.
[3]Viscosity was measured using a Brookfield RVT viscometer.
[4]Young's modulus was measured on an Instron Tensile Testing machine, Model 1122, according to ASTM D-2523.
[5]Ultimate elongation or percent strain at break was generated on an Instron tensile testing machine, Model 1122.
[6]Glass transition temperature was measured using torsional samples on a Rheometrics Dynamic Spectrometer, Model RDS7700, by conducting a temperature sweep spanning the range from 0° C. to −100° C. at a fixed strain of 0.02%. The glass transition temperature is read from the loss modulus curve.

Overlay Asphalt C and Control C were used to manufacture both fiberglass and organic shingles using conventional fabrication equipment and methods. The glass shingles had a fiberglass web weighing about two pounds per 100 square feet, coated on either side with a conventional filled coating (247° F. softening point, 64.8% dolomitic limestone) and #11 roofing granules being embedded in the upper surface thereof. Rectangular and/or trapezoidal overlays were applied using either Overlay Asphalt C or Control Asphalt C and then embedded with #11 roofing granules to give Example 3 and Comparative Example 3.

The organic version consisted of a 45 PT (9 lbs. per 100 square feet) felt substrate saturated with conventional shingle saturant (softening point 140° F.), coated on either side with a conventional filled coating (247° F. softening point, 64.8% calcium carbonate), and #11 roofing granules being embedded in the upper surface thereof. Rectangular and/or trapezoidal overlays were applied using #11 roofing granules to yield Example 4 and Comparative Example 4. Tensile and theological properties of the shingles were measured using the Instron Tensile Tester (Model 1122) (Young's modulus, ultimate elongation) and a Rheometrics' Dynamic Spectrometer, Model RDS7700 (crack temperature, percent strain), both one month after the shingles were manufactured, as well as after ageing the shingles for five weeks and ten weeks at 70° C. Crack temperatures are determined from a three point bend test conducted using the Rheometrics' spectrometer on a shingle specimen in which a normal force applied to the backcoating. The full range of the test is 0.2% strain, and the temperature at which cracking occurred and the percent strain or elongation at cracking are reported. The results of these measurements are reported below in Tables V and VI.

TABLE V

| Property | Example 3 | Comparative Ex. 3 |
|---|---|---|
| Initial: | | |
| Young's modulus (20° F.) | 29,470 psi | 49,520 psi |
| Ultimate elongation (20° F.) | 4.2% | 3.3% |
| Crack temp., % strain | −42° C., 0.08% | −32° C., 0.10% |
| After 5 weeks at 70° C.: | | |
| Young's modulus (20° F.) | 57,010 psi | 59,900 psi |
| Crack temp., % strain | −40° C., 0.04% | −30° C., 0.15% |
| After 10 weeks at 70° C.: | | |
| Crack temp., % strain | −10° C., 0.12% | 0° C., 0.14% |

The significant increase in modulus between Example 3 and Comparative Example 3 suggests that the shingles with the modified overlays will be less susceptible to cracking as shingles expand and contract in response to movement of the roof deck during climatic changes. This hypothesis is reinforced by the Rheometrics data which demonstrates that even after a ten week ageing period, the shingles with a modified overlay perform significantly better than their unmodified counterparts, in that cracking occurred only at a significantly lower temperature (−10° C.) than in the case of the control (0° C.).

Figure 9:
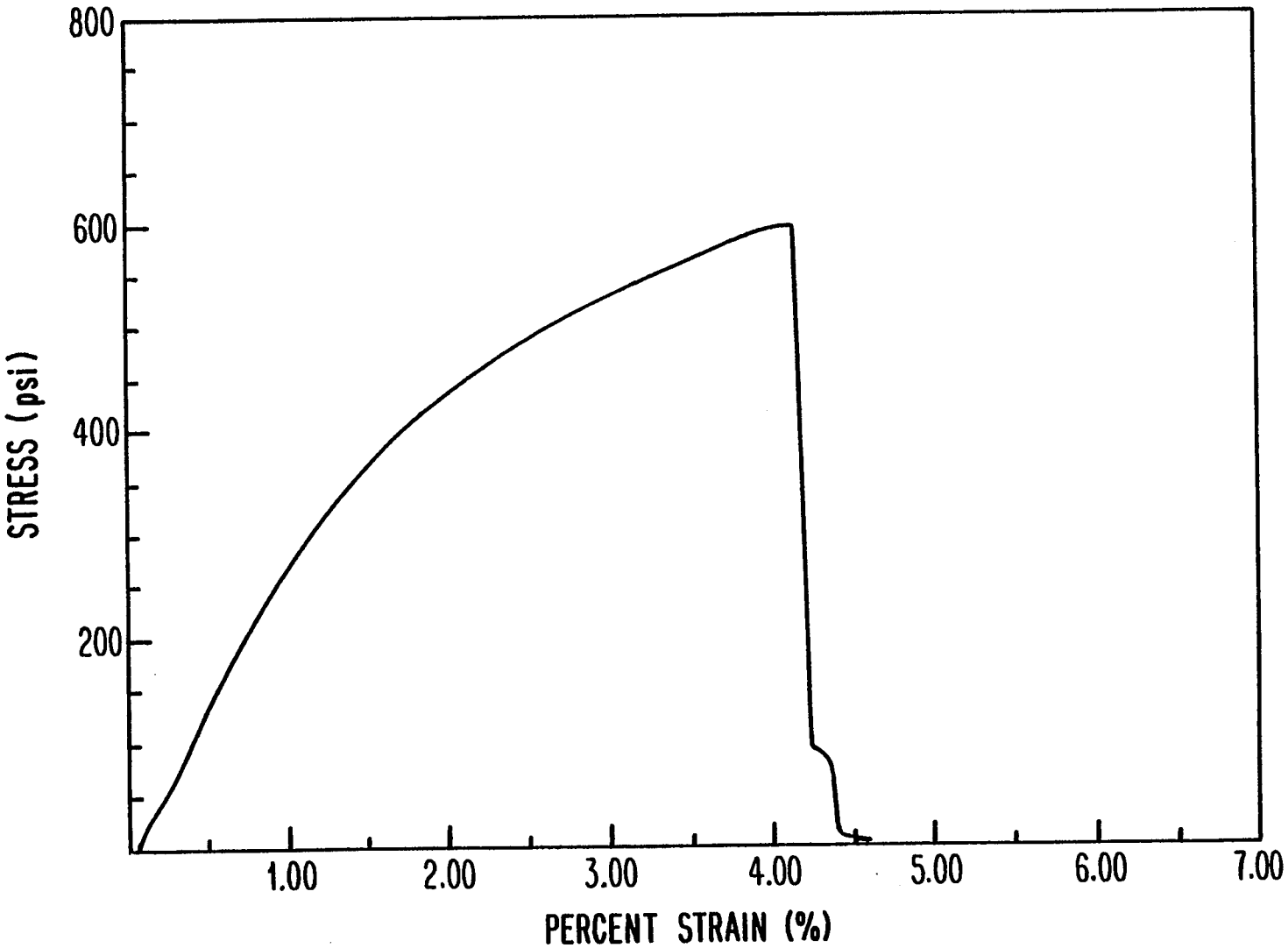
FIG. 9 is a graph of stress versus strain for a second shingle of the present invention measured at −6.7° C. without prior ageing of the shingle.
Figure 10:
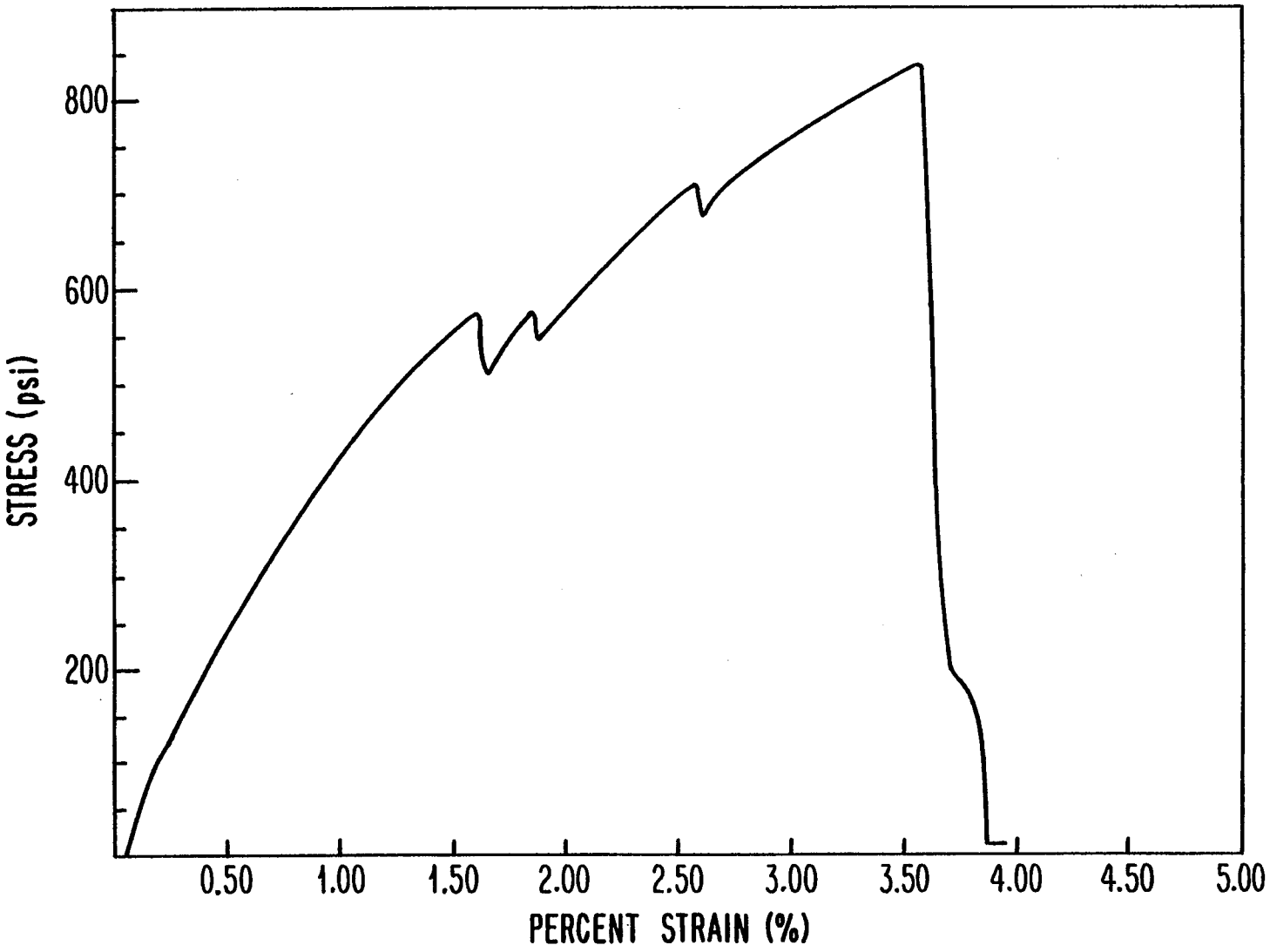
FIG. 10 is a graph of stress versus strain for a control shingle for the shingle of FIG. 9.

FIGS. 9 and 10 are stress-strain curves for Example 3 and Comparative Example 3, respectively, measured for unaged specimens at −6.7° C. As shown by the numerous "blips" in FIG. 10, the unmodified overlay shingle of Comparative Example 3 cracked extensively. Signs of overlay cracking are first evident at strain levels of 1.5%.

TABLE VI

| Property | Example 4 | Comparative Ex. 4 |
|---|---|---|
| Initial: | | |
| Young's modulus (20° F.) | 30,310 psi | 39,280 psi |
| ultimate elongation (20° F.) | 4.8% | 4.0% |
| crack temp., % strain | −42° C., 0.18% | −32° C., 0.10% |
| After 5 weeks at 70° C.: | | |
| Young's modulus (20° F.) | 49,780 psi | 63,220 psi |
| crack temp., % strain | −30° C., 0.16% | −20° C., 0.10% |
| After 10 weeks at 70° C.: | | |
| crack temp., % strain | −20° C., 0.15% | 20° C., 0.11% |

Again, the higher elongation and lower modulus of the initial asphalt (Example 4) suggests that the modified overlay will absorb the roof stresses without cracking. This conclusion is supported by the three point bend test conducted on the Rheometrics' Dynamic Spectrometer both before and after the ten week aging period. Clearly the difference in cracking susceptibility (between the modified and unmodified shingle overlay) is more pronounced in the organic shingles as opposed to the fiberglass as demonstrated by the 40° C. spread in cracking temperature.

Figure 11:
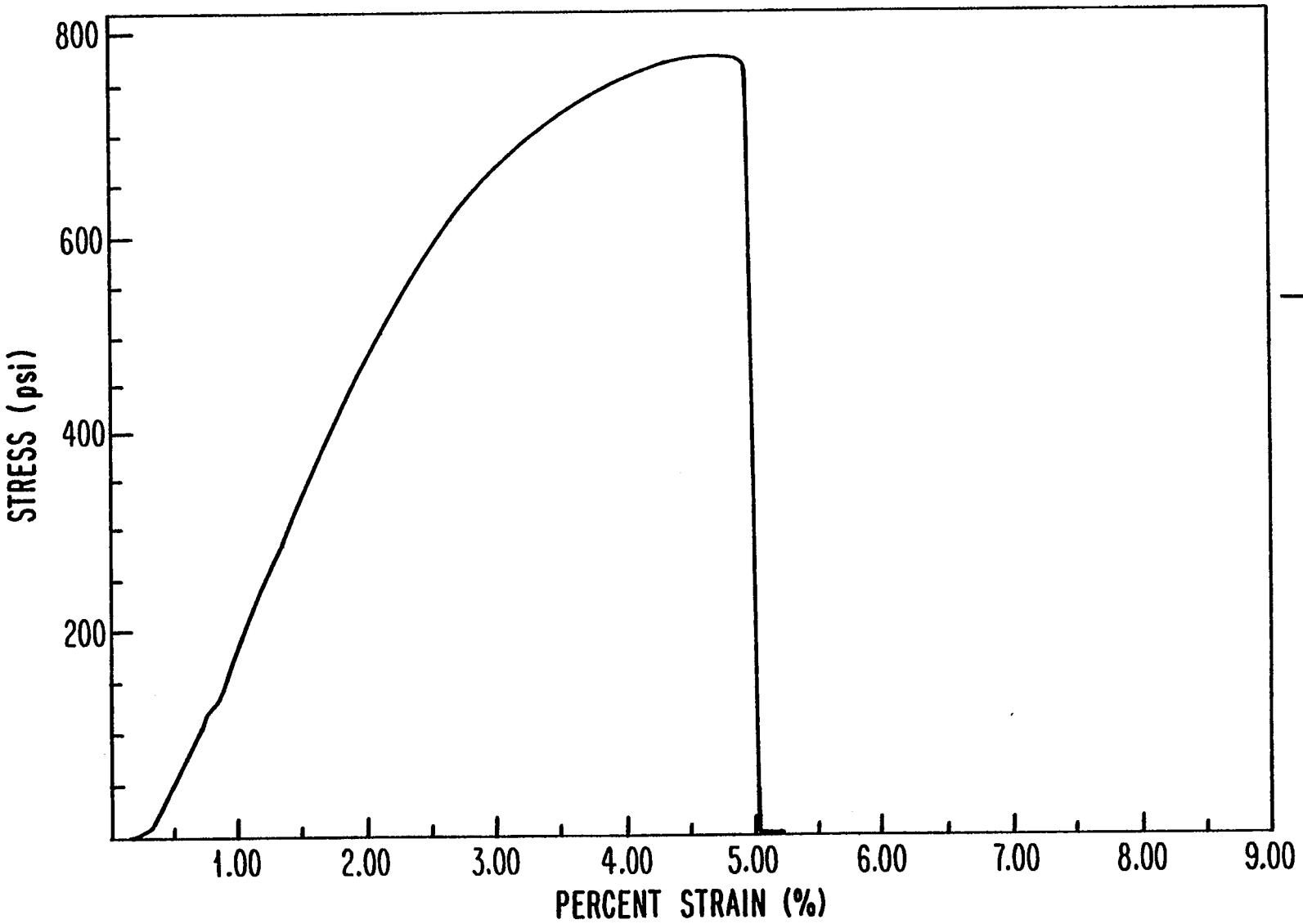
FIG. 11 is a graph of stress versus strain for a third shingle of the present invention measured at −6.7° C. without prior ageing of the shingle.
Figure 12:
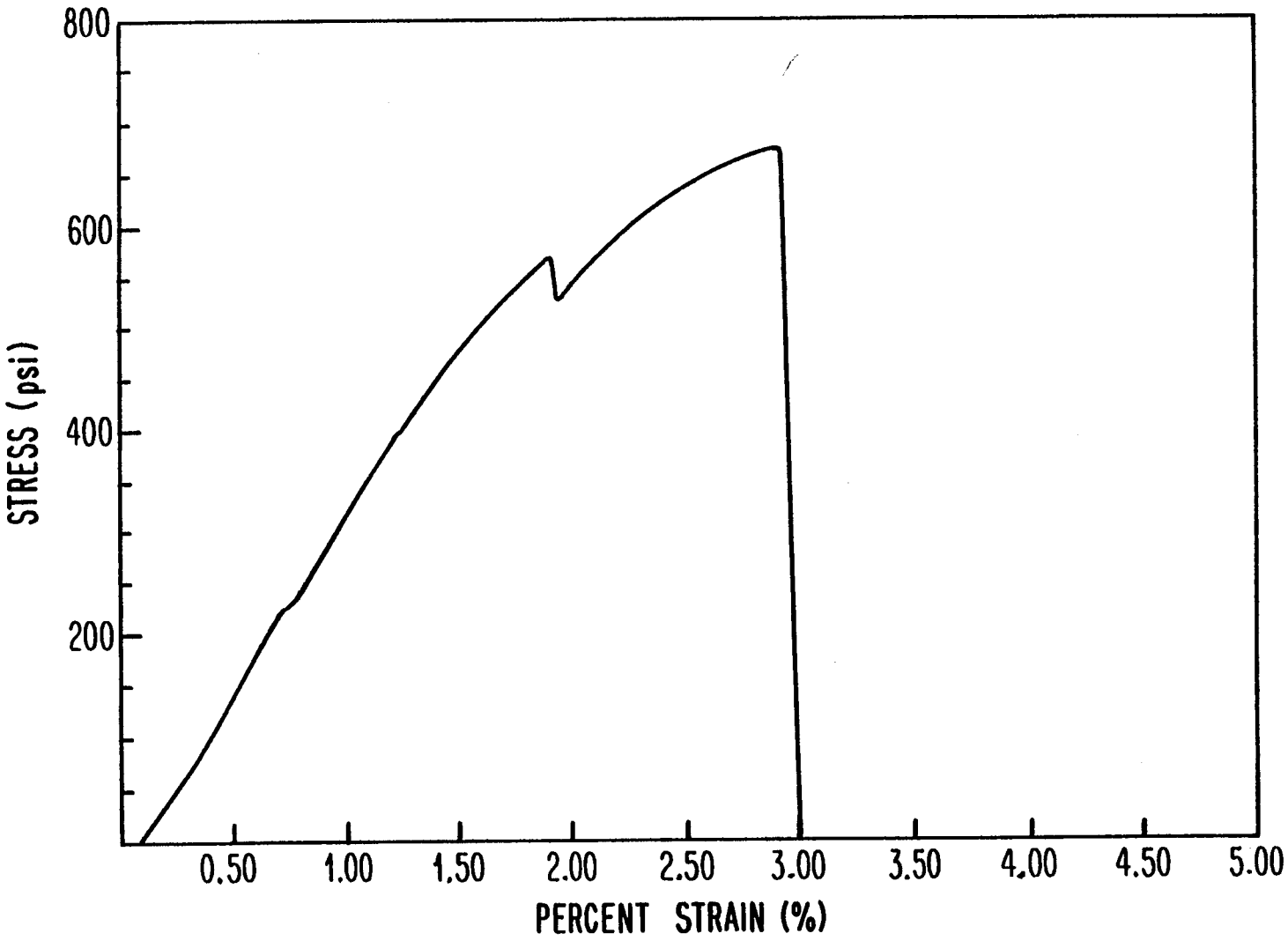
FIG. 12 is a graph of stress versus strain for a control shingle for the shingle of FIG. 11.

FIGS. 11 and 12 are stress-strain curves for Example 4 and Comparative Example 4 respectively, measured for unaged specimens at −6.7° C. As in the case of the fiberglass-reinforced shingles of FIGS. 9 and 10, the unmodified overlay presented in FIG. 12 (organic shingle) cracks at 1.75% strain, in comparison with the modified version presented in FIG. 11 which shows no signs of cracking.

Tables VII and VIII present tensile data for overlay formulations A and C and their respective control samples. All data was generated on a Model 1122 Instron testing machine.

The data in Table VII show significantly higher elongation and lower modulus achieved for Overlay Asphalt A in comparison with Control Asphalt A over the nineteen-week extended accelerated ageing period. The fact that elongations and moduli are relatively stable throughout the aging period suggests that the modified overlay formulation will provide crack resistance for a long period of exterior exposure. The data presented in Table VIII for Overlay Asphalt C suggest that this formulation will also be less susceptible to cracking than its respective control. The modulus of Overlay Asphalt C after ten weeks' aging is about the same as that of the control at the outset. The elongation of the modified asphalt is almost three times that of the control after the ageing period.

TABLE VII

| | aging period (weeks)[1] | | | | | |
|---|---|---|---|---|---|---|
| | 0 | 2 | 3 | 6 | 11 | 19 |
| Overlay Asphalt A | | | | | | |
| tensile stress (psi)[2] | 26 | 86 | 91 | 107 | 113 | 117 |
| ultimate elongation (%) | >56 | >56 | >56 | >56 | >56 | >56 |
| modulus (psi) | 2580 | 3945 | 3815 | 4235 | 5250 | 4830 |
| Control Asphalt A | | | | | | |
| tensile stress (psi)[2] | 305 | 396 | 328 | 345 | 379 | 347 |
| ultimate elongation (%) | 7.06 | 1.29 | 0.87 | 0.83 | 0.47 | 0.49 |
| modulus (psi) | 26860 | 48950 | 58710 | 63990 | 99015 | 107630 |

[1]Accelerated aging achieved by storing asphalt specimens in 70° C. oven for given time period.
[2]Mechanical properties measured at −1.1° C.

TABLE VIII

| | aging period (weeks)[1] | | |
|---|---|---|---|
| | 0 | 2 | 10 |
| Overlay Asphalt C | | | |
| tensile stress (psi)[2] | 198 | 298 | 154 |
| ultimate elongation | 14.0 | 4.8 | 3.7 |
| modulus (psi) | 8930 | 19910 | 35470 |
| Control Asphalt C | | | |
| tensile stress (psi)[2] | 493 | 367 | 175 |
| ultimate elongation (%) | 4.7 | 1.8 | 1.3 |
| modulus (psi) | 34590 | 50190 | 74220 |

[1]Accelerated aging achieved by storing asphalt specimens in a 70° C. oven for given time period.
[2]Mechanical properties measured −6.7° C.

EXAMPLE 5

A modified asphalt (Overlay Asphalt D) was prepared by mixing the following components in a low shear mixer at 185° C. for 30 minutes:

| Component | Weight Percent |
|---|---|
| shingle coating, a highly oxidized asphalt with a softening point of 102° C. | 28.8% |
| dolomitic limestone | 51.2% |
| styrene-butadiene block copolymer/mineral oil blend in a 2:1 weight ratio | 20.0% |

The physical properties of Overlay Asphalt D were measured and are compared in Table IX below with those of Control Asphalt D, an asphaltic composition comprising 34 percent by weight of a coatings grade asphalt (softening point 93° C.–116° C.) and 64 percent by weight dolomitic limestone.

TABLE IX

| Property | Overlay Asphalt D | Control Asphalt D |
|---|---|---|
| Initial: | | |
| glass transition[1] temperature | −56° C. | −32° C. |
| strain-to-fail[2] | no cracking through −56° C. | cracks at −22° C., 0.9% strain |
| Young's modulus[3] −7° C. | 15,270 psi | 34,370 psi |
| After aging five weeks at 70° C.: | | |
| Young's modulus[3] −7° C. | 39,070 psi | 54,980 psi |
| strain-to-fail[2] at −2° C. | 2.3% | 1.3% |

[1]The glass transition temperature of the asphalt composition was measured as above.
[2]Strain-to-fail was measured using the Rheometrics Dynamic Spectometer by subjecting the asphalts to a strain sweep at a fixed temperature, −2° C. The maximum strain was 3.0%
[3]Young's modulus was measured as above.

The results in Table IX show that overlay blend is not as stiff as the control and therefore will be less susceptible to cracking; the lower glass transition temperature and strain to fail support this inference.

EXAMPLE 6

A modified asphalt (Overlay Asphalt E) was prepared by mixing the following components in a low shear mixer at 185° C. for 30 minutes:

| Component | Weight Percent |
|---|---|
| shingle coating, a highly oxidized asphalt with a softening point of 102° C. | 34.2% |
| dolomitic limestone | 60.8% |
| low volatility monomeric phthalate ester plasticizer (molecular weight = 475) | 5.0% |

The physical properties of Overlay Asphalt E were measured and are compared in Table X below with those of Control Asphalt B:

TABLE X

| Property | Overlay Asphalt E | Control Asphalt B |
|---|---|---|
| Initial: | | |
| glass transition[1] temperature | −52° C. | −32° C. |
| strain-to-fail[2] | no cracking through −32° C. | cracks at −22° C., 0.9% strain |
| Young's modulus[3] −7° C. | 1,340 psi | 34,370 psi |
| After aging five weeks at 70° C.: | | |
| Young's modulus[3] −7° C. | 7,810 psi | 54,980 psi |
| strain-to-fail[2] | cracks at −32° C., | 1.3% |

TABLE X-continued

| Property | Overlay Asphalt E | Control Asphalt B |
|---|---|---|
| at −2° C. | 1.3% strain | |

[1]The glass transition temperature of the asphalt composition was measured as above.
[2]Strain-to-fail was measured as above.
[3]Young's modulus was measured as above.

The results in Table X show that plasticizer alone reduces the potential of overlay cracking as exemplified by glass transition temperature and significantly lower modulus.

Various modifications can be made in the details of the various embodiments of the process and shingles of the present invention, all within the spirit and scope of the invention as defined by the appended claims. For example, the overlay employed in the present invention can be applied to multiple layer or laminated shingles, in which there is more than a single web-reinforced layer making up the base shingle.

We claim:

1. A shingle comprising:

a) a first element including a reinforcing web, a first asphaltic binder, and a first adherent surfacing material, and b) a second element overlaid on the first element, the second element including a layer of second asphaltic binder and a second adherent surfacing material, the second asphaltic binder having a greater elongation than the first asphaltic binder.

2. A shingle according to claim 1 wherein the second asphaltic binder has an elongation at break of at least two percent.

3. A shingle according to claim 2 wherein the second asphaltic binder has an elongation at break of at least two percent measured at about −1° C. after ageing the shingle for least ten weeks at 70° C.

4. A shingle according to claim 2 wherein the second element comprises a plurality of discontinuous sections.

5. A shingle according to to claim 1 wherein the second element has a penetration of less than about 75 decimillimeters at 25° C.

6. A shingle according to claim 1 wherein the second asphaltic binder is non-adhesive at ambient temperature.

7. A shingle according to claim 1 wherein the second asphaltic binder includes a softening composition comprising elastomer and plasticizer.

8. A shingle according to claim 7 wherein the elastomer is selected from natural rubber and thermoplastic elastomers.

9. A shingle according to claim 8 wherein the elastomer is a thermoplastic elastomer selected from styrene-isoprene-styrene block copolymer, styrene-butadiene-stryrene block copolymer, and styrene-ethylene-butadiene-styrene block copolymer.

10. A shingle according to claim 9 wherein the elastomer is a styrene-butadiene-styrene radial elastomer.

11. A shingle according to claim 8 wherein the second asphaltic binder comprises a mixture of atactic polypropylene and isotactic polypropylene.

12. A shingle according to claim 8 wherein the thermoplastic elastomer comprises a styrene-butadiene block copolymer.

13. A shingle according to claim 12 wherein the second asphaltic binder further comprises mineral oil.

14. A shingle according to claim 13 wherein the weight ratio of mineral oil to thermoplastic elastomer is up to about 3:1.

15. A shingle according to claim 14 wherein the weight ratio of mineral oil to thermoplastic elastomer is about 2.5:1.

16. A shingle according to claim 7 wherein the plasticizer is a monomeric phthalate ester.

17. A shingle according to claim 7 wherein the softening composition further comprises antioxidant.

18. A shingle according to claim 7 wherein the softening composition has a Brookfield viscosity of from about 2000 to 7000 centipoise at 400° F.

19. A shingle according to claim 8 wherein the second asphaltic binder comprises from about 30 to 70 percent by weight of an thermoplastic block elastomer.

20. A shingle according to claim 1 wherein the second asphaltic composition has a glass transition temperature measured before ageing at least ten degrees Centigrade less than the glass transition temperature of the first asphaltic composition.

21. A roof covering comprising a plurality of shingles according to claim 1.

22. A roofing membrane comprising:

a) a first element including a reinforcing web, a first asphaltic binder, and a first adherent surfacing material, and b) a second element overlaid on the first element, the second element including a layer of a second asphaltic binder and a second adherent surfacing material, the second asphaltic binder having greater elongation than the first asphaltic binder.

* * * * *

UNITED STATES PATENT AND TRADEMARK OFFICE

CERTIFICATE OF CORRECTION

PATENT NO. : 5,347,785
DATED : September 20, 1994
INVENTOR(S) : Louis Terrenzio et al It is certified that error appears in the above-indentified patent and that said Letters Patent is hereby corrected as shown below:

Column 2, Line 25, after the word "accelerated" add --ageing--.

Column 3, Line 31, after the word "is" add --shown--.

Column 11, Line 56, delete "theological" and substitute therefore --rheological.

Signed and Sealed this

Twentieth Day of December, 1994

*Attest:*

Bruce Lehman

BRUCE LEHMAN

*Attesting Officer*

*Commissioner of Patents and Trademarks*